33-258 SR
4/5/88 XR 4,734,990

United States Patent [19]

Sanders

[11] Patent Number: 4,734,990

[45] Date of Patent: Apr. 5, 1988

[54] VIEWING APPARATUS

[75] Inventor: Ronald J. Sanders, Ramsey, Minn.

[73] Assignee: Pursuit Corporation, Anoka, Minn.

[21] Appl. No.: 855,959

[22] Filed: Apr. 25, 1986

[51] Int. Cl.[4] ..... F41G 1/06; F41G 1/16; F41G 1/34

[52] U.S. Cl. ..... 33/244; 33/241; 33/258; 33/277

[58] Field of Search ..... 33/233, 241, 244, 246, 33/258, 265, 277, 297, 298

[56] References Cited

U.S. PATENT DOCUMENTS

| | | | |
|---|---|---|---|
| 2,030,312 | 2/1936 | Mossberg | 33/244 |
| 2,275,631 | 3/1942 | Johnson | 33/298 |
| 2,519,727 | 8/1950 | Yezdan | 33/277 |
| 3,112,566 | 12/1963 | Jones | 33/233 |
| 3,392,450 | 7/1968 | Herter et al. | 33/297 |
| 3,820,248 | 6/1974 | Hayward | 33/244 |
| 3,974,585 | 8/1976 | Dunham | 33/241 |
| 4,016,654 | 4/1977 | Tepedino | 33/277 |
| 4,055,000 | 10/1977 | Cesin | 33/241 |
| 4,141,163 | 2/1979 | Rubin | 33/244 |
| 4,316,145 | 2/1982 | Tann | 324/208 |
| 4,385,297 | 5/1983 | Schmitt et al. | 324/208 |
| 4,391,563 | 7/1983 | Vietor | 116/230 X |
| 4,458,436 | 7/1984 | Bohl | 33/241 |
| 4,571,694 | 2/1986 | Inaba et al. | 901/46 |
| 4,606,696 | 8/1986 | Slocum | 901/46 |

FOREIGN PATENT DOCUMENTS

| | | | |
|---|---|---|---|
| 238209 | 9/1911 | Fed. Rep. of Germany | 33/233 |

*Primary Examiner*—Richard R. Stearns
*Attorney, Agent, or Firm*—Peterson, Wicks, Nemer & Kamrath

[57] ABSTRACT

A viewing apparatus for the purpose of separating a particular view from its surroundings and for the purpose of identifying the distance of the viewed object is disclosed. A viewing apparatus that attaches to and is used in conjunction with firearms weaponry is disclosed. The apparatus is characterized by an enclosed and elongated see through hooded opening attached directly to said firearms weaponry and is used to direct and aid open sight viewing of a distant object by blocking out immediate surroundings and thereby separating the view of said object from its immediate surroundings. The apparatus is affixed with a calibrates scale designed to measure distance of a distant object according to its height. The apparatus can be affixed with additional apparatus for precise windage and elevation adjustment.

14 Claims, 2 Drawing Sheets

VIEWING APPARATUS

BACKGROUND OF THE INVENTION

Firearms weaponry—rifles, shotguns, handguns—is currently affixed with one type of open sighting or another and is quite often affixed with special optical lenses, scopes, etc., which in effect are designed to aid viewing by magnification of a particular viewed object for the purpose of better aiming and placement of a discharged projectile from said firearms weaponry. Although in many instances magnification is the preferred method of sighting distant targets, it is in many instances used in situations where over or under focusing can cause magnification too extreme or insufficient for many types of firearms useage such as woodland, swamp and brush hunting or just a short yardage situation in which open sights would present a more acceptable view. Another downfall of using optical lenses for magnification of a viewed object is condensation due to the enclosed tubular structure which can develop in extreme cold or inclement weather. But with said open sights now furnished on firearms weaponry, it is necessary to have good lighting at the time of aim or a lighted background to the viewing area so that the currently used open sights can be aligned properly. Also, distant shots are more difficult to execute with accuracy and the blotting out of part of the target at even acceptable distances makes for unprecise shooting.

This invention relates then to the incorporation of the two most widely used means of aiming a firearms weapon. It is designed to eliminate the downfalls of both open sight aiming and optical lens magnification aiming and at the same time incorporate more important factors not found in either aforementioned methods of aiming at a viewed object, such as quickly establishing a target area at close range because of the separation of the desired target area from its surroundings. The invention is also unaffected by weather conditions and can improve aiming capability in darkened conditions. It is also an aid in identifying the distance of a viewed object.

Although the features of this invention which are believed to be novel are set forth in the claims, details as to its organization and method of operation, together with the further objects and advantages thereof, may be best understood through reference to the following description taken in connection with the accompanying drawings, wherein:

DESCRIPTION OF THE PREFERRED EMBODIMENTS

Figure 1:
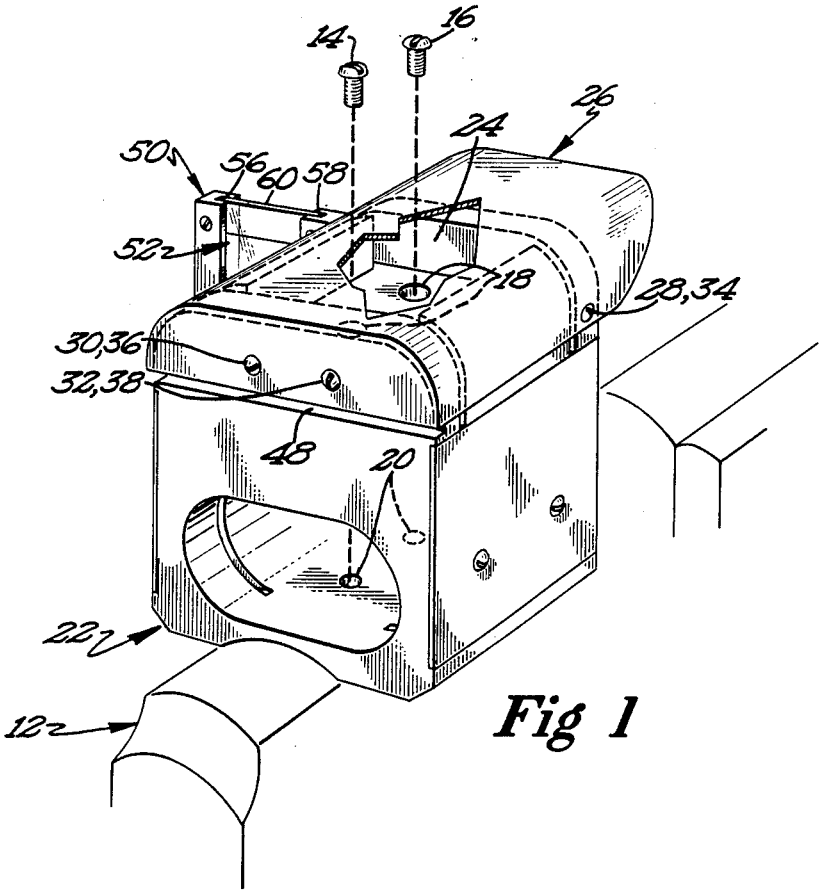
FIG. 1 is a perspective view consisting of the viewing apparatus with distance calibration device attached.
Figure 2:
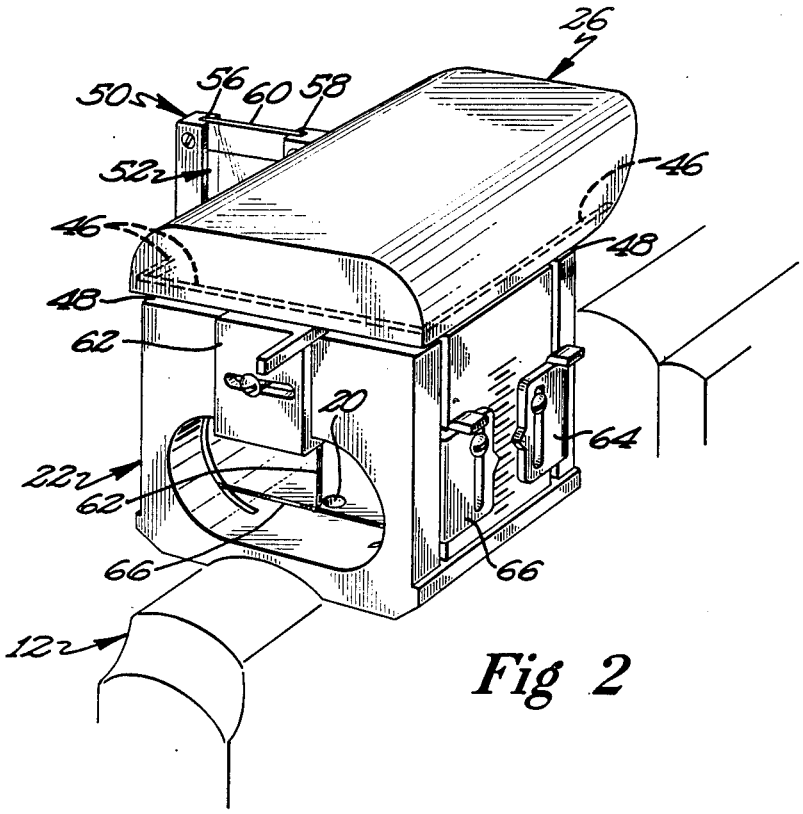
FIG. 2 is a perspective view consisting of the viewing apparatus with distance calibration device and one means of adjustable windage and elevation mechanics.
Figure 3:
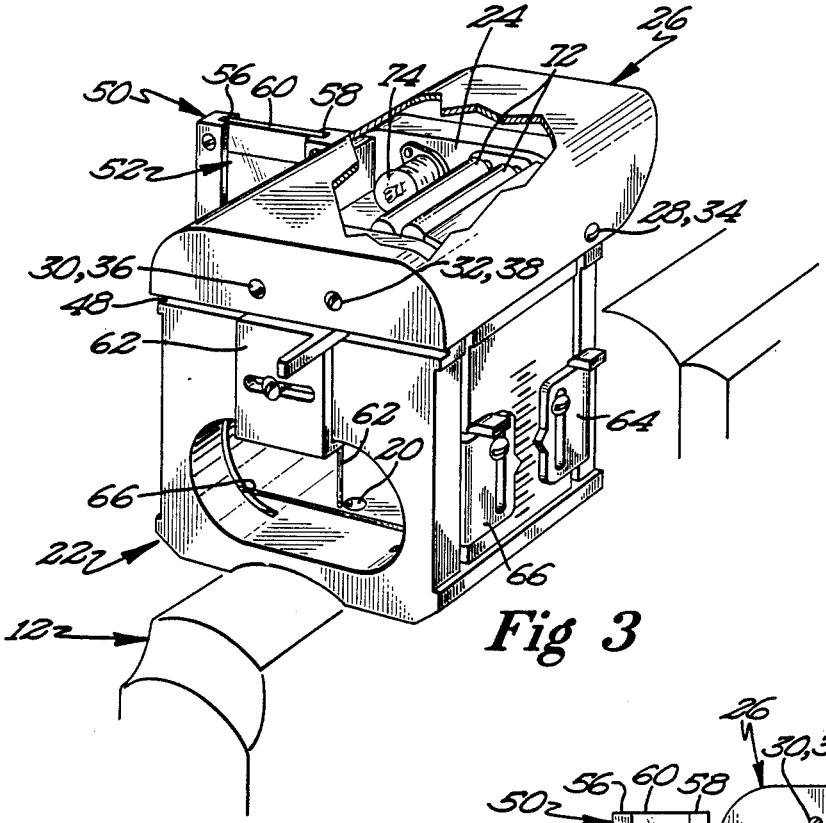
FIG. 3 is a perspective view consisting of the viewing apparatus with adjustments and lighting apparatus and distance calibration device.

Referring now to the drawings in detail, wherein like numerals indicate like elements throughout the several views, FIGS. 1, 2 and 3 illustrate a viewing apparatus for use with a firearms weapon, generally designated by the numeral 12. Attached to 12 by two threaded screws 14 and 16 and passed through clearance holes 18 and 20 is the base of viewing apparatus 22. Viewing apparatus 22 is an enclosed and elongated see through hooded opening structure used to separate a targeted object from its immediate surroundings. Once viewing apparatus 22 is secured to weapon 12 by tightening screws 14 and 16 down with a screwdriver passed through open top 24 of viewing apparatus 22, the cap 26 is secured to 22 by one or more means. As one means, referring to FIG. 1, threaded screws 28, 30 and 32 are passed through clearance holes 34, 36 and 38 and screwed into tapped holes in viewing apparatus 22. As another means, referring to FIG. 2, cap 26 is attached to viewing apparatus 22 by snap over slots 46 molded or otherwise applied to cap 26 and ridges 48 are molded or otherwise applied to viewing apparatus 22 at various locations, thereby securing cap 26. Distance calibration device 50 is then fitted to the side of viewing apparatus 22 by a slide mechanism 52 molded or otherwise applied to viewing apparatus 22 and on the side 54 of distance calibration device 50, whereby once slid into place, numerous clear, rectangular shaped slides 60 showing various calibrated distances according to height engraved, etched or otherwise marked or slotted on its surface can be interchanged and held vertically in place by slots 56 and 58 on either side of distance calibration device 50.

Figure 4:
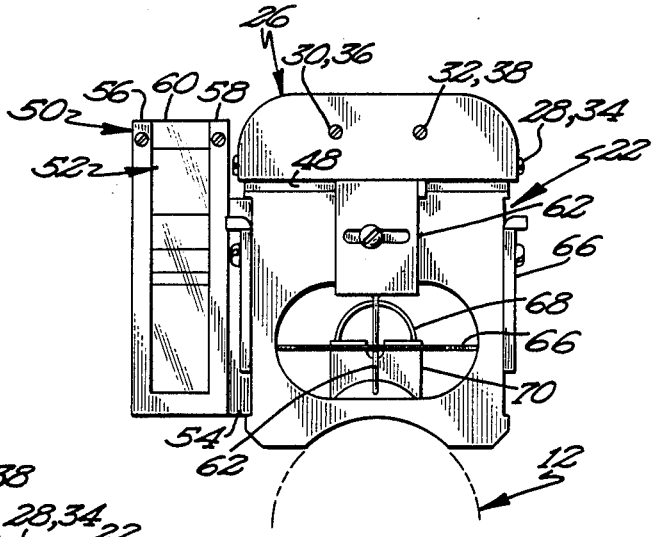
FIG. 4 is a rear view of the viewing apparatus showing sights lining up with crosshairs.
Figure 5:
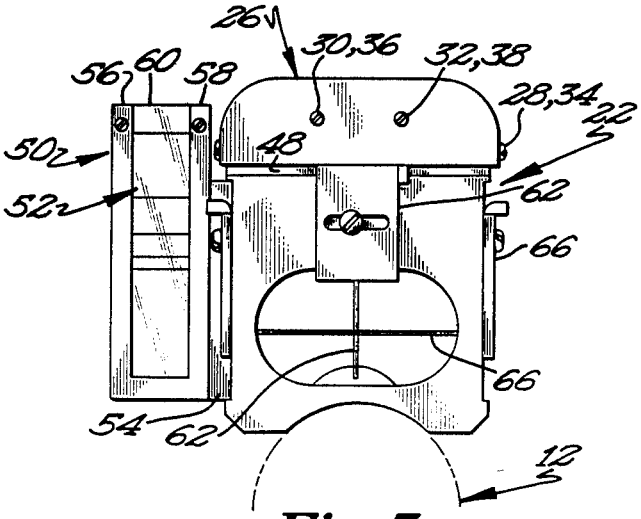
FIG. 5 is a rear view of the viewing apparatus showing the crosshairs lined up with the front and the rear sights of weapon dropped or removed.

Whereas in FIG. 1, viewing apparatus 22, cap 26, and distance calibration device 50 create the body and the main structure of a viewing apparatus in FIG. 2. The viewing apparatus is shown with windage adjustment 62 and separate elevation adjustments 64 and 66, all of which can be aligned with the front sight 68 and the rear sight 70 of weapon 12 in FIG. 4. In its most preferred form, windage adjustment 62 includes at least one vertically held rod within the enclosed and elongated see through hooded opening structure of viewing apparatus 22 which is connected to an adjustment lever. Likewise, elevation adjustments 64 and 66 each include a horizontally held rod within the enclosed and elongated see through hooded opening structure of viewing apparatus 22 which is connected to an adjustment lever. Once aligned with properly sighted open sights 68 and 70, then sights 68 and 70 of weapon 12 can be lowered or removed, clearing a fuller view of a target as in FIG. 5.

FIG. 3 shows the viewing apparatus affixed with all previously mentioned components and one means of lighting windage adjustment 62 and elevation adjustments 64 and 66 when coated with flourescent material from bracket attachment 72 and a light 74. Attachment 72 can also be placed internally in open top 24 of viewing apparatus 22 or in other locations not shown in figures but attached to viewing apparatus 22. Further provided is a light 74 operated by a battery or other power cell that is turned on by various means and light 74 is directed at flourescent adjustments 62, 64 and 66.

It is obvious that a new open sighting system for firearms weaponry is hereby created and can be a valuable accessory used by sportsmen to reduce the risk of wounded game animals and accidental shootings because it forces the user to concentrate on his target more readily, yet does not reduce his ability to quickly focus on a target.

It should be understood that the specific embodiments of the invention herein disclosed are of a descriptive rather than a limiting nature, and that various changes, combinations, substitutions or modifications may be employed in accordance with these teachings without departing either in spirit or scope from this invention in its broader aspects.

What is claimed is:

1. Viewing apparatus for use with weaponry affixed with a sighting system for sighting distant targets along a sight line comprising, in combination: a plurality of slides allowing the distant targets to be seen therethrough; means formed on each of the slides for marking precalculated distances for viewing the distant target and establishing predetermined distances; and means secured to the sighting system for slidably receiving one of the plurality of slides for slideable movement along an axis generally perpendicular to the sight line of the sighting system allowing interchange of the slides according to the type of target of the weaponry sought.

2. The viewing apparatus of claim 1 wherein the slides comprise plates formed of clear material allowing the distant target to be seen therethrough.

3. The viewing apparatus of claim 2 wherein the marking means comprises precalculated distance calibrations etched on the clear plates.

4. Viewing apparatus for use with weaponry affixed with a sighting system for sighting distant targets along a sight line including an enclosed and see through opening for directing viewing of the distant target therethrough and separating the distant target from its immediate surroundings, comprising, in combination: a plurality of slides allowing the distant targets to be seen therethrough; means formed on each of the slides for marking precalculated distances for viewing the distant target and establishing predetermined distances; and means for removably holding one of the plurality of the slides outside the enclosed and see through opening adjacent to but spaced from the sight line of the sighting system with the slide being in a plane generally perpendicular to the sight line of the sighting system allowing interchange of the slides according to the type of target of the weaponry sought.

5. The viewing apparatus of claim 4 wherein the enclosed and see through opening of the sighting system includes a first end and a second end, with the second end being intermediate the first end and the distant target; wherein the sighting system further includes a hood attached to and extending beyond the second end of the enclosed and see through opening and toward the distant target.

6. The viewing apparatus of claim 5 wherein the sighting system comprises, in combination: at least one horizontal rod within the enclosed and see through opening; a first adjustment lever located outside the enclosed and see through opening and connected to the horizontal rod; means for adjustably mounting the first adjustment lever to the outside of the enclosed and see through opening allowing elevation adjustment of the horizontal rod within the enclosed and see through opening; at least one vertical rod within the enclosed and see through opening; a second adjustment lever located outside the enclosed and see through opening and connected to the vertical rod; and means for adjustably mounting the second adjustment lever to the outside of the enclosed and see through opening allowing windage adjustment of the vertical rod within the enclosed and see through opening.

7. The viewing apparatus of claim 6 wherein the horizontal rod and the vertical rod are at least partially coated with florescent material within the enclosed and see through opening; and wherein the viewing apparatus further comprises, in combination: means located within the enclosed and see through opening and spaced from the horizontal rod and the vertical rod for providing light directed to the florescent coating of the horizontal rod and the vertical rod.

8. The viewing apparatus of claim 5 wherein the sighting system is located within the enclosed and see through opening and is at least partially coated with florescent material within the enclosed and see through opening; and wherein the viewing apparatus further comprises, in combination: means located within the enclosed and see through opening and spaced from the sighting system for providing light directed to the florescent coating of the sighting system.

9. The viewing apparatus of claim 8 wherein the light providing means comprises, in combination: a light located within the enclosed and see through opening and spaced from the sighting system.

10. Viewing apparatus for use with weaponry for sighting distant targets along a sight line comprising, in combination: an enclosed and see through opening for directing viewing of the distant target therethrough and separating the distant target from its immediate surroundings; at least one horizontal rod within the enclosed and see through opening; a first adjustment lever located outside the enclosed and see through opening and connected to the horizontal rod; means for adjustably mounting the first adjustment lever to the outside of the enclosed and see through opening allowing elevation adjustment of the horizontal rod within the enclosed and see through opening; at least one vertical rod within the enclosed and see through opening; a second adjustment lever located outside the enclosed and see through opening and connected to the vertical rod; and means for adjustably mounting the second adjustment lever to the outside of the enclosed and see through opening allowing windage adjustment of the vertical rod within the enclosed and see through opening.

11. The viewing apparatus of claim 10 wherein the horizontal rod and the vertical rod are at least partially coated with florescent material within the enclosed and see through opening; and wherein the viewing apparatus further comprises, in combination: means located within the enclosed and see through opening and spaced from the horizontal rod and the vertical rod for providing light directed to the florescent coating of the horizontal rod and the vertical rod.

12. The viewing apparatus of claim 11 wherein the light providing means comprises, in combination: a battery operated light located within the enclosed and see through opening and spaced from the horizontal rod and the vertical rod.

13. The viewing apparatus of claim 11 wherein the enclosed and see through opening includes a first end and a second end, with the second end being intermediate the first end and the distant target; wherein the viewing apparatus further comprises in combination: a hood attached to and extending beyond the second end of the enclosed and see through opening and toward the distant target.

14. The viewing apparatus of claim 10 wherein the enclosed and see through opening includes a first end and a second end, with the second end being intermediate the first end and the distant target; wherein the viewing apparatus further comprises in combination: a hood attached to and extending beyond the second end of the enclosed and see through opening and toward the distant target.

* * * * *